US006003706A

United States Patent [19]

Rosen

[11] Patent Number: 6,003,706

[45] Date of Patent: Dec. 21, 1999

[54] ADJUSTABLE DEPTH INSULATED CONTAINER

[75] Inventor: Morton I. Rosen, Deerfield, Ill.

[73] Assignee: Polyfoam Packers Corporation, Wheeling, Ill.

[21] Appl. No.: 09/156,198

[22] Filed: Sep. 17, 1998

[51] Int. Cl.[6] ..... B65D 8/18

[52] U.S. Cl. ..... 220/4.26

[58] Field of Search ..... 220/4.26, 4.27, 220/4.03

[56] References Cited

U.S. PATENT DOCUMENTS

| | | | |
|---|---|---|---|
| 883,451 | 3/1908 | Collier . | |
| 1,101,357 | 6/1914 | Thompson . | |
| 2,972,407 | 2/1961 | Taylor . | |
| 3,251,460 | 5/1966 | Edmonds | 220/4.26 |
| 3,561,666 | 2/1971 | Spinks et al. . | |
| 3,627,393 | 12/1971 | Hickson et al. . | |
| 3,856,178 | 12/1974 | Norgaard . | |
| 4,082,208 | 4/1978 | Lane, Jr. . | |
| 4,978,023 | 12/1990 | Behlmann et al. | 220/4.26 |
| 5,332,114 | 7/1994 | Sano et al. | 220/4.27 |
| 5,385,326 | 1/1995 | Bidwell . | |
| 5,474,195 | 12/1995 | Pai . | |
| 5,535,908 | 7/1996 | Sheu . | |
| 5,617,679 | 4/1997 | Meyers . | |
| 5,634,559 | 6/1997 | Foos et al. . | |
| 5,678,716 | 10/1997 | Umiker . | |
| 5,690,249 | 11/1997 | Karlsten . | |
| 5,697,500 | 12/1997 | Walker . | |
| 5,720,410 | 2/1998 | Umiker | 220/4.26 |

FOREIGN PATENT DOCUMENTS

| | | | |
|---|---|---|---|
| 1545867 | 10/1968 | France | 220/4.26 |

OTHER PUBLICATIONS

Polyfoam Packers Corp. "Protective Packaging for Gourmet Gifts of Distinction" brochure (published 1997) cover and pp. 4 & 8.

*Primary Examiner*—Stephen Castellano
*Attorney, Agent, or Firm*—Emrich & Dithmar

[57] ABSTRACT

An expandable container is provided which includes first and second nestable modules respectively having first and second peripheral sidewalls. The first module has a first nesting surface portion on the first sidewall and the second member has a second nesting surface portion on the second sidewall nestable with the first nesting surface portion in a nested configuration. The first nesting surface portion has a recess and the second nesting surface portion has a projection interference fittable in the recess in the nested configuration to releasably retain the modules in the nested configuration. At least one of the first and second modules has a bottom wall connected to the associated peripheral sidewall.

15 Claims, 6 Drawing Sheets

ADJUSTABLE DEPTH INSULATED CONTAINER

BACKGROUND OF THE INVENTION

1. Field of the Invention

This invention relates to containers and, more particularly, to insulated containers.

2. Description of the Prior Art

Though insulated containers are available in different dimensions, these dimensions are usually fixed and non-changeable. Therefore, a supplier shipping differently sized objects must maintain an inventory of differently sized containers to accommodate his goods. This causes several problems. First, the differently sized containers may not be geometrically shaped to be easily stored together, thereby wasting precious warehouse space. Second, the supplier must maintain a larger inventory of containers to fit each of his products. Third, none of the choices of fixed-depth containers may adequately accommodate the sizes of some of his goods.

SUMMARY OF THE INVENTION

It is a general object of the invention to provide an improved variable-depth container, while affording additional structural and operating advantages.

An important feature of the invention is the provision of a variable-depth container which is of relatively simple and economical construction.

A further feature of the invention is the provision of a container of the type set forth which can easily have its depth reconfigured to one of many sizes to accommodate differently sized objects to be stored therein.

Another feature of the invention is the provision of a thermally insulating container of the type set forth whose individual components are economically storable together to minimize storage space.

A still further feature of the invention is the provision of a container of the type set forth, which includes a plurality of depth-adding modules, each securely connected to a base or to another such module, so as not to significantly impair thermal insulation properties.

One or more of these features may be attained by providing an expandable container including first and second nestable modules respectively having first and second peripheral sidewalls. The first module has a first nesting surface portion on the first sidewall and the second module has a second nesting surface portion on the second sidewall nestable with the first nesting surface portion in a nested configuration. The first nesting surface portion has a recess and the second nesting surface portion has a projection interference fittable in the recess in the nested configuration to releasable retain the modules in the nested configuration. At least one of the first and second modules has a bottom wall connected to the associated peripheral sidewall.

The invention consists of certain novel features and a combination of parts hereinafter fully described, illustrated in the accompanying drawings, and particularly pointed out in the appended claims, it being understood that various changes in the details may be made without departing from the spirit, or sacrificing any of the advantages of the present invention.

BRIEF DESCRIPTION OF THE DRAWINGS

For the purpose of facilitating an understanding of the invention, there is illustrated in the accompanying drawings a preferred embodiment thereof, from an inspection of which, when considered in connection with the following description, the invention, its construction and operation, and many of its advantages should be readily understood and appreciated.

DETAILED DESCRIPTION OF THE PREFERRED EMBODIMENT

Figure 1:
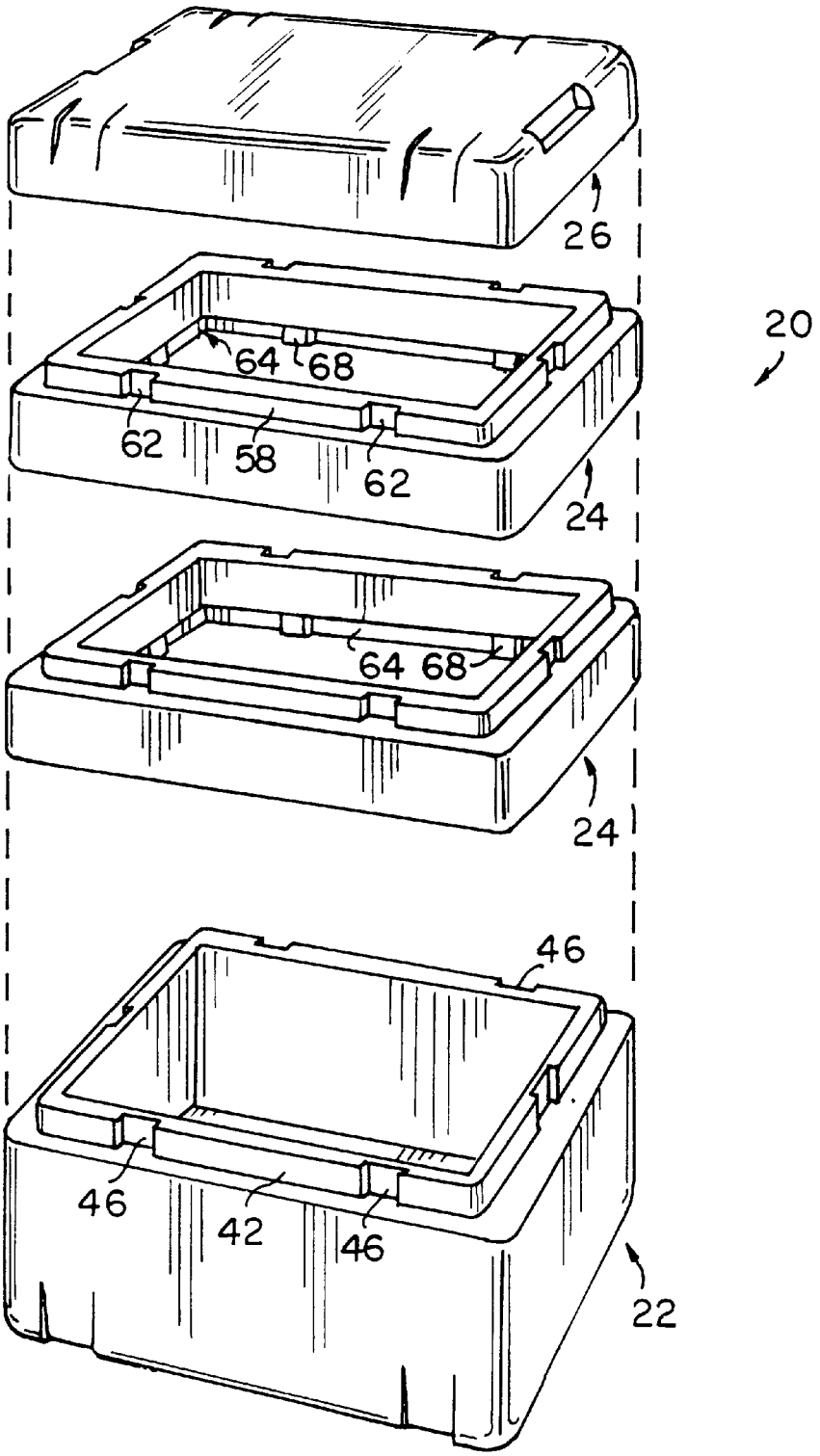
FIG. 1 is an exploded perspective view of the container of the present invention.

Referring to the drawings, an insulated container 20 is molded from a rigid foam material having good thermal insulating properties, such as expanded polystyrene or the like. Though this is a rigid foam, it is still somewhat compressible and flexible.

Figure 11:
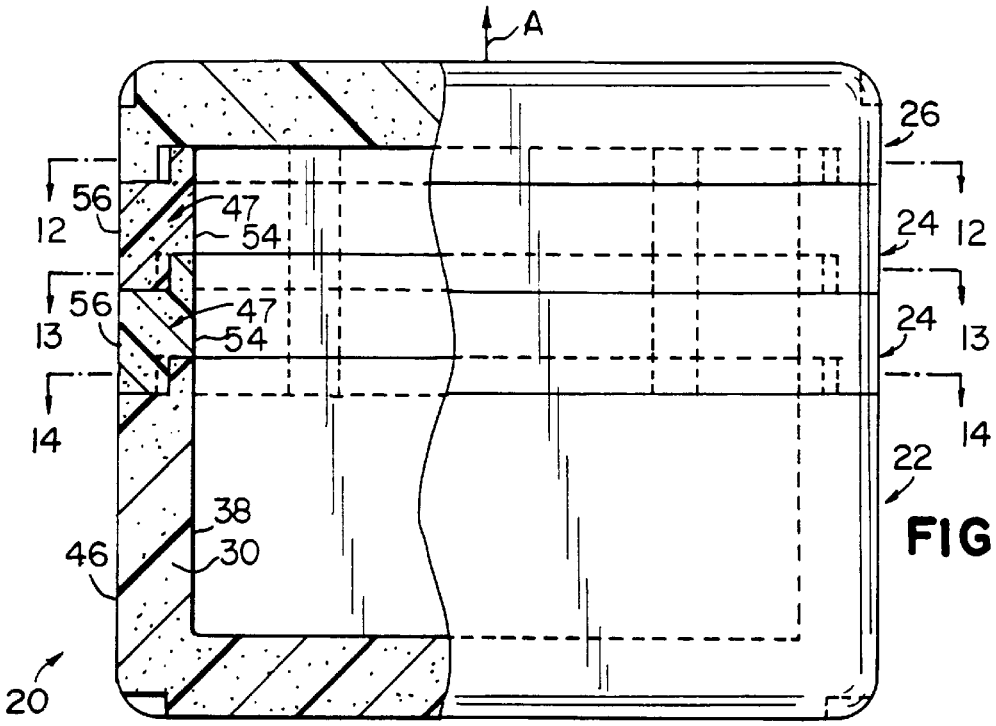
FIG. 11 is an enlarged side elevational view, partially in section, of the container of FIG. 1 fully assembled.

As seen in FIGS. 1 and 11, the container 20 includes a plurality of nestable modules including a base 22, a plurality of depth-adding, hollow rings 24 and a lid 26. The container 20 has a central axis A (FIG. 11).

Figure 8:
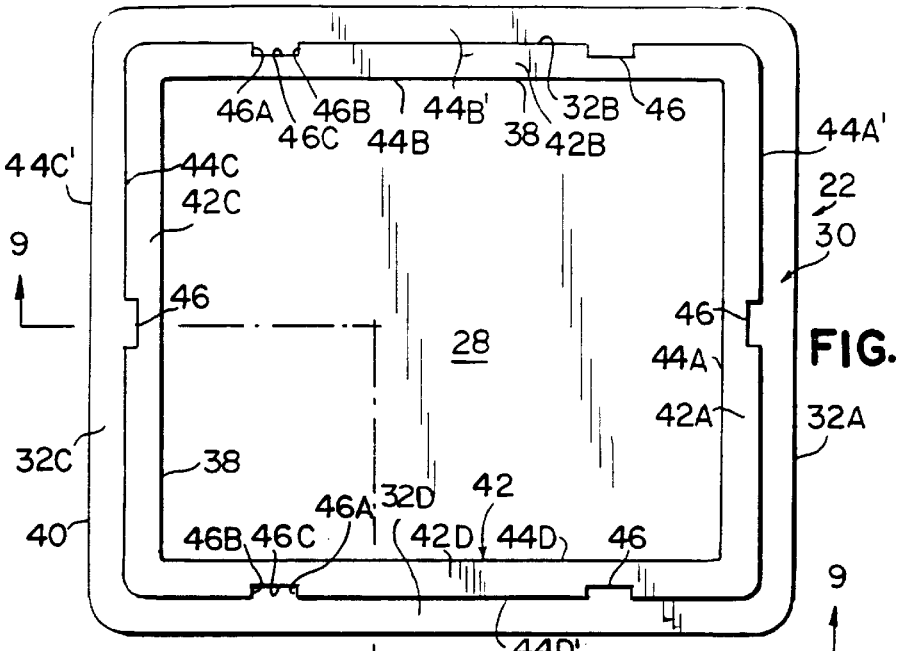
FIG. 8 is an elongated top plan view of the base of the container of FIG. 1.
Figure 9:
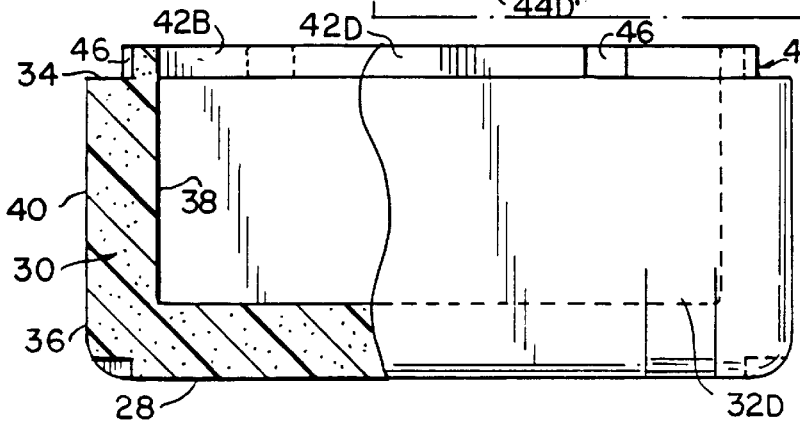
FIG. 9 is a view taken generally along line 9—9 of FIG. 8.
Figure 10:
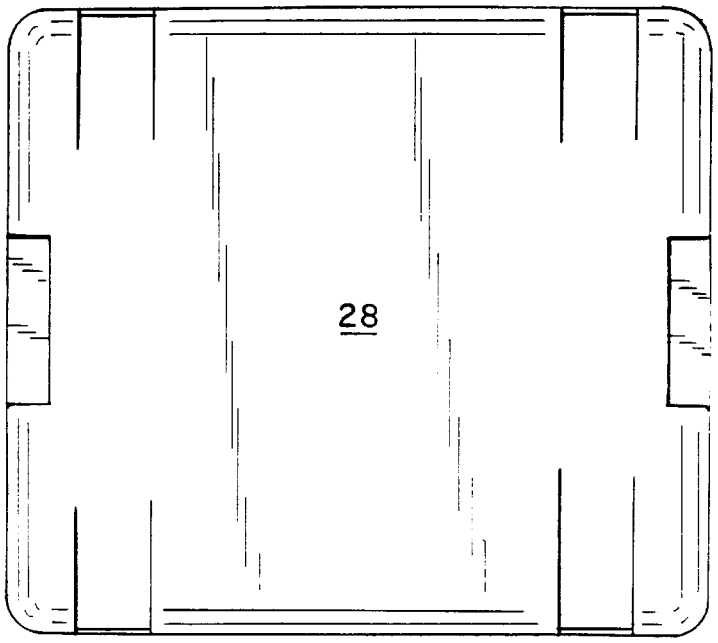
FIG. 10 is a bottom plan view of the base of FIG. 8.

As seen in FIGS. 8–10, the base 22 includes a bottom wall 28 and a peripheral sidewall 30 made up of four integral sidewall sections 32A–D. The sidewall 30 has an upper end 34, a lower end 36 integral with the bottom wall 28, and an interior surface 38 and an exterior surface 40.

A peripheral flange 42 (or nesting surface portion) projects from the upper end 34 of sidewall 30 and is spaced from the exterior surface 40 of the sidewall 30. The flange 42 includes four flange sections 42A–D respectively having inner and outer planar surfaces 44A–D, 44A'–D' respectively substantially parallel to sidewall sections 32A–D. Each of the inner planar surfaces 44A–D is disposed between the interior and exterior surfaces 38 and 40 of sidewall 30. Flange sections 42A, 42B are, respectively, parallel to flange sections 42C, 42D. The flange 42 includes six open, recesses or notches 46. As seen best in FIG. 8, each recess 46 is formed of two substantially parallel walls 46A, 46B and a wall 46C connecting walls 46A and 46B. Each of walls 46A and 46B has a length, as measured from the associated outer planar surface 44A–D to wall 46C, and wall 46C has a length as measured between walls 46A and 46B.

Figure 5:
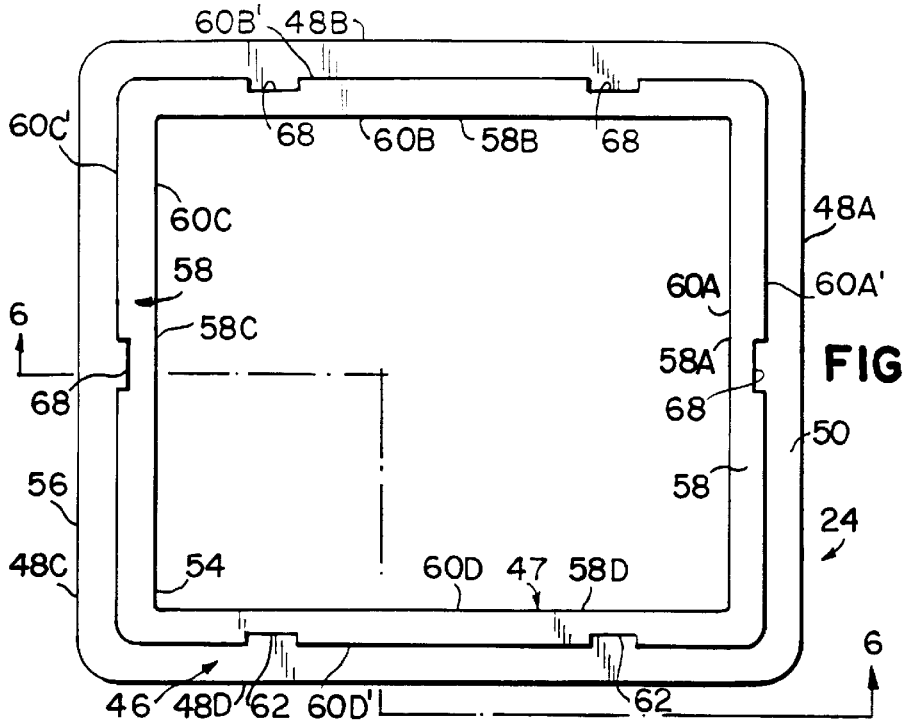
FIG. 5 is an enlarged top plan view of a stackable ring of the container of the container of FIG. 1.
Figure 6:
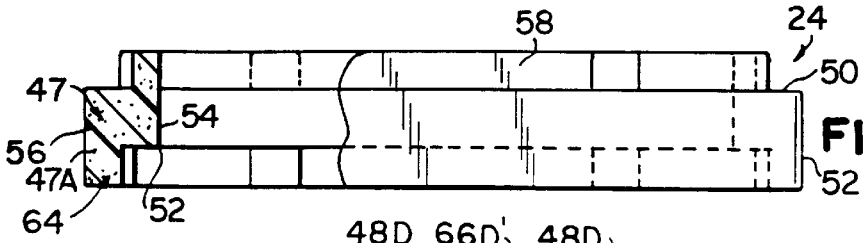
FIG. 6 is a view taken generally along line 6—6 of FIG. 5.
Figure 7:
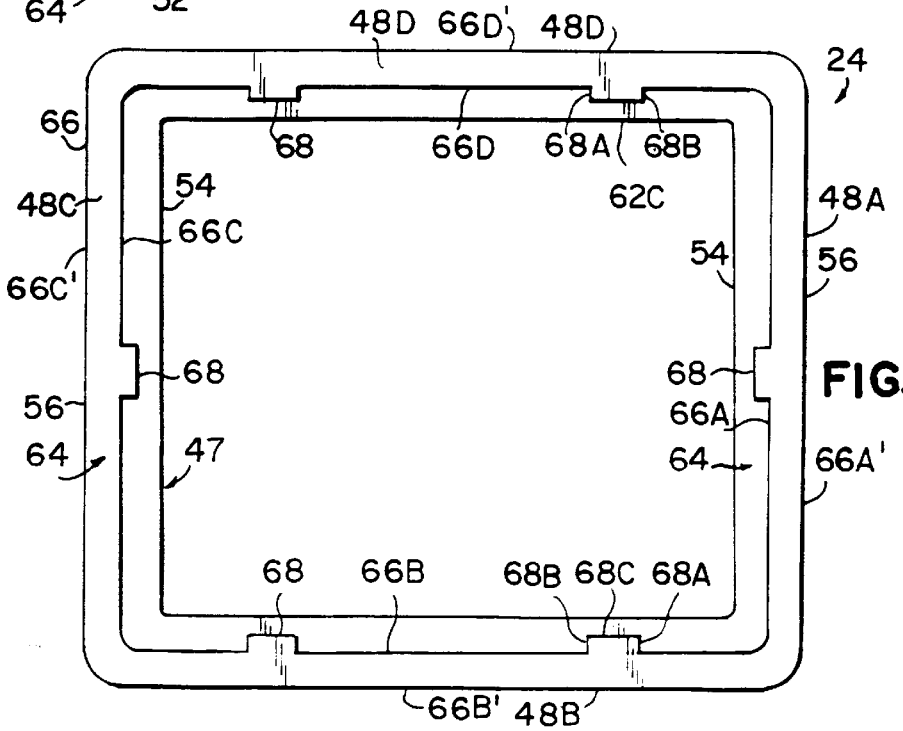
FIG. 7 is a bottom plan view of the ring of FIG. 5.

As seen in FIGS. 5–7, each of the hollow rings 24 includes a rectangular peripheral sidewall 47 made up of four integral sidewall sections 48A–D. Sidewall sections 48A, 48B are, respectively, parallel to sidewall sections 48C, 48D. The sidewall 47 has an upper end 50, a lower end 52 (FIG. 6), an interior surface 54, and an exterior surface 56. As best seen in FIGS. 5–6, each of the hollow rings 24 also includes an upper peripheral flange 58 (or nesting surface portion) projecting from the upper end 50 of the sidewall 47. The flange 58 has four flange sections 58A–D, respectively having inner and outer planar surfaces 60A–D, 60A'–D', respectively substantially parallel to sidewall sections 48A–D. Each of the outer planar surfaces 60A'–D' are disposed between the interior and exterior surfaces 54 and 56. Flange sections 58A, 58B are, respectively, parallel to flange sections 58C, 58D. The upper peripheral flange 58 also includes six open recesses or notches 62 recessed from associated planar surfaces 60A–D. The recesses 62 have substantially the same dimensions as the recesses 46. Each recess 62 is formed by two parallel side walls 62A, 62B and a wall 62C connecting the walls 62A and 62B. Walls 62A and 62B each have a length as measured from associated planar surfaces 60A–D to wall 62C and wall 62C has a length as measured between walls 62A and 62B. The lengths of walls 62A–C are, respectively, substantially equal to the lengths of walls 46A–C.

As best seen in FIGS. 6–7, each hollow ring 24 also includes a lower peripheral flange 64 (or nesting surface portion) projecting from the lower end 52 of sidewall 47 and spaced from the interior surface 54 of the peripheral sidewall 47. The lower peripheral flange 64 includes four flange sections 64A–D, respectively having inner and outer planar surfaces 66A–D, 66A'–D' which are, respectively, substantially parallel to sidewall sections 48A–D. The flange 64 also includes six projections or ribs 68 projecting from associated inner planar surfaces 66A–D.

As best seen in FIG. 7, each of the ribs 68 has two parallel side walls 68A, 68B and a wall 62C connecting the walls 68A, 68B. The walls 68A–C each have a length. Walls 68A, 68B have a length as measured from wall 68C to an associated inner planar surfaces 66A–D, and wall 68C has a length as measured between walls 68A and 68B.

The lengths of walls 68A–C are, respectively, substantially equal to both the lengths of walls 62A–C of recess 62 and the lengths of walls 46A–C of recess 46.

Figure 2:
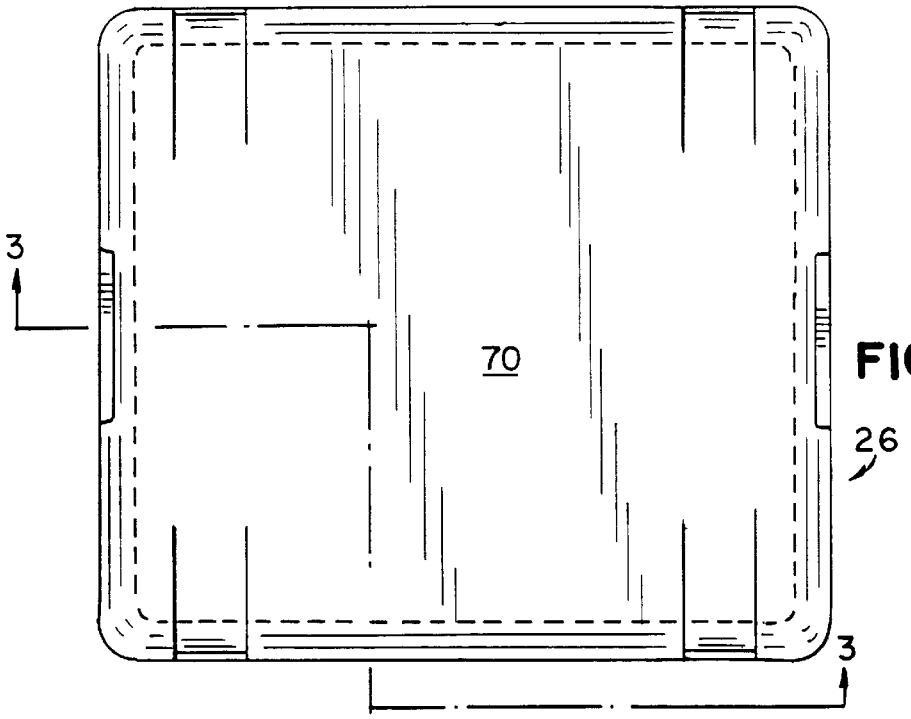
FIG. 2 is an enlarged top plan view of the lid of the container of FIG. 1.
Figure 3:
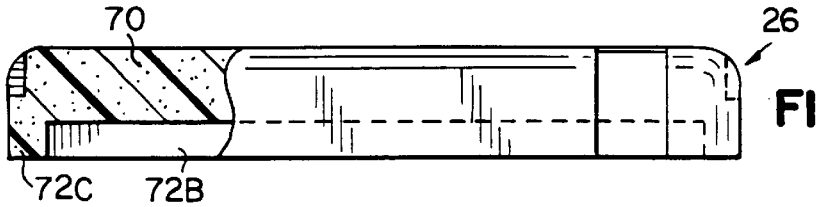
FIG. 3 is a view taken generally along line 3—3 of FIG. 2.
Figure 4:
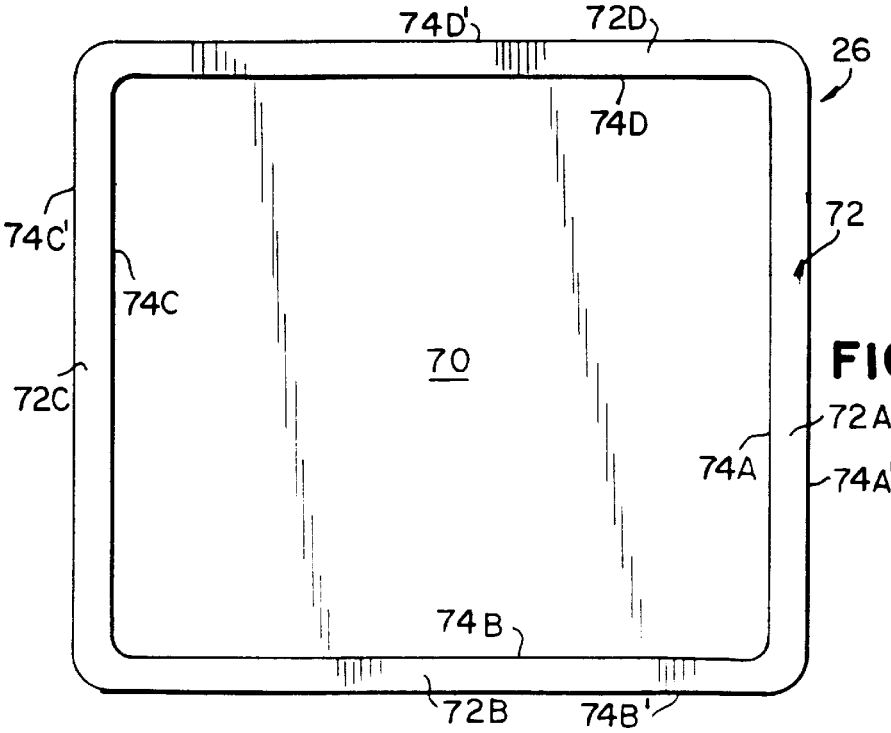
FIG. 4 is a bottom plan view of the lid of FIG. 2.

As seen in FIGS. 2–4, the lid 26 of the container 20 has a top wall 70, and a lower peripheral flange 72 (or nesting surface portion) made of four integral sidewalls 72A–D depending therefrom. Sidewalls 72A, 72B are, respectively, parallel to sidewalls 72C, 72D. The sidewalls 72A–D respectively have inner and outer planar surfaces 74A–D, 74A'–D'.

Figure 14:
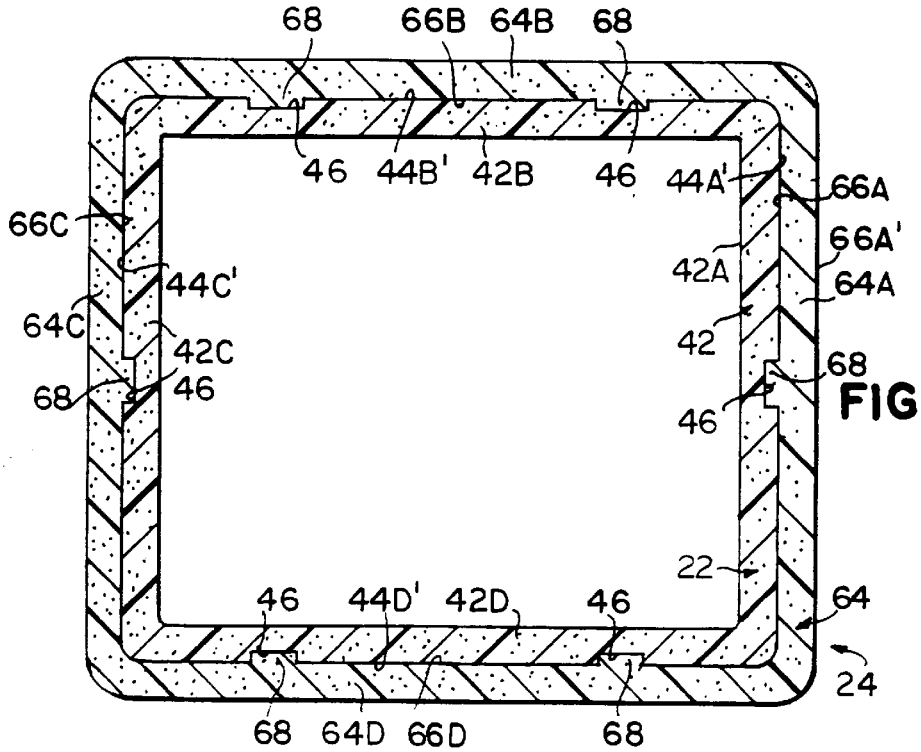
FIG. 14 is a sectional view taken generally along line 14—14 of FIG. 11.

When the container 20 is in its assembled stale, as seen in FIG. 11, each of the modules 22, 24, 26 is removeably coupled to any module disposed above or below it by an interference fit. The base 22, as seen in FIG. 14, is coupled to the ring 24 disposed above it by an interference fit between lower peripheral flange 64 and peripheral flange 42 formed by the respective mating of the outer planar surfaces 44A'–D' of the flange sections 42A–D with the inner planar surfaces 66A–D of flange sections 64A–D, and the respective mating of ribs 68 of the lower peripheral flange 64 with associated recesses 46 of peripheral flange 42 of the base 22. The ribs 6B are somewhat compressible and the recesses 46 are somewhat expandable to accommodate this mating.

Figure 13:
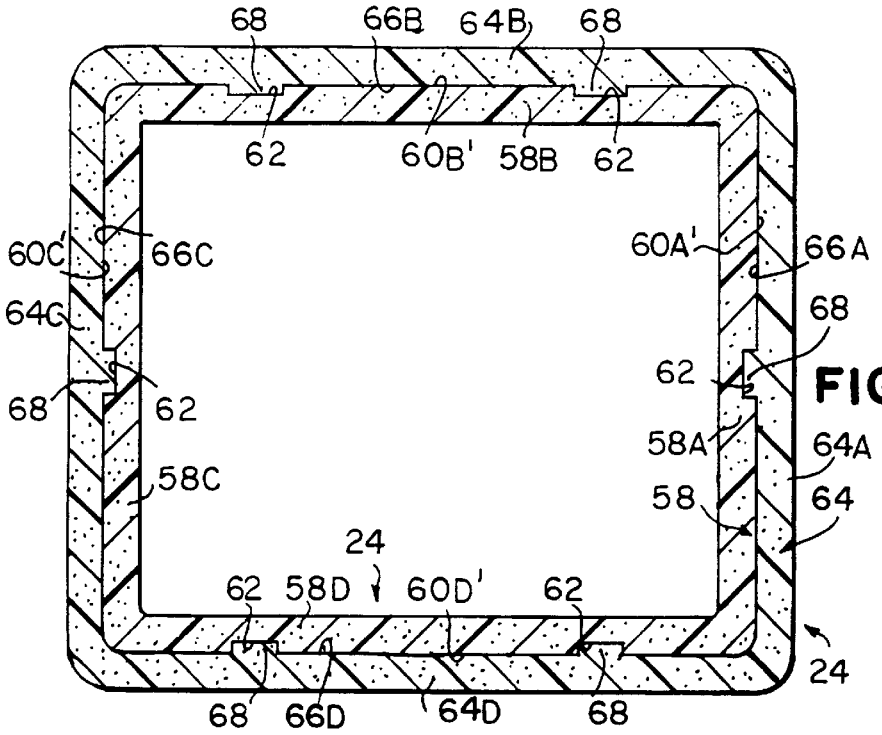
FIG. 13 is a sectional view taken generally along line 13—13 of FIG. 11.

Similarly, as seen in FIG. 13, the hollow rings 24 are each removeably coupled to each other by an interference fit between the lower peripheral flange 64 of one hollow ring 24 and the upper peripheral flange 58 of the hollow ring 24 directly below. The interference fit is formed by the respective mating of the outer planar surfaces 60A'–D' of flange sections 58A–D with the inner planar surfaces 66A–D of flange sections 64A–D and the mating of each of the ribs 68 of lower peripheral flange 64 with an associated recess 62 of the upper peripheral flange 58. Like recesses 46, recesses 62 are somewhat expandable to accommodate this mating.

Figure 12:
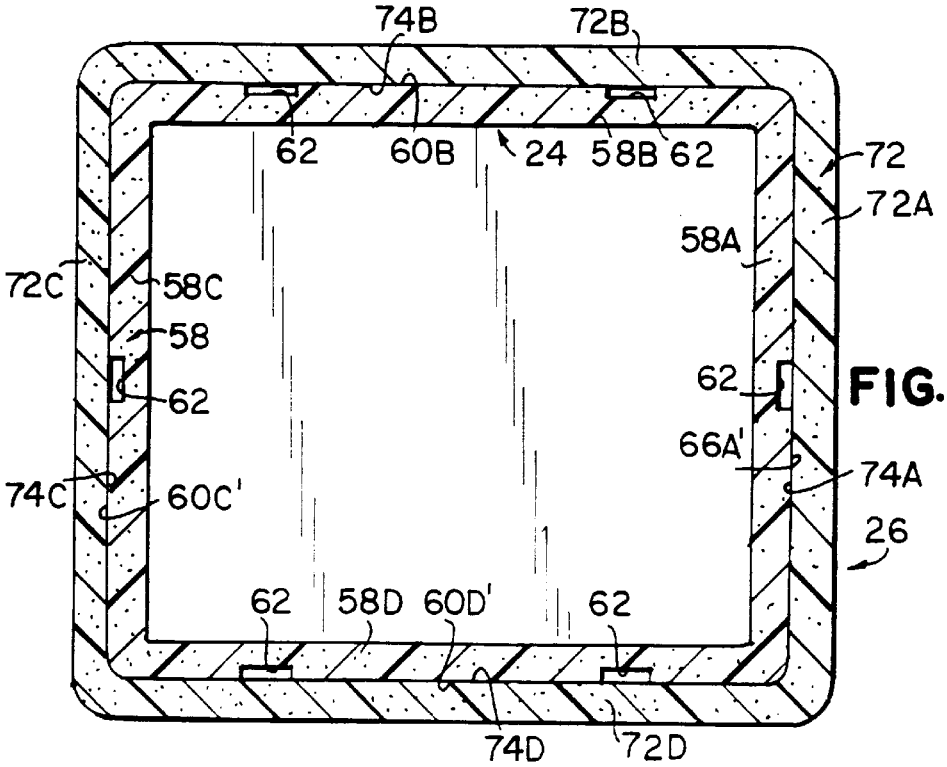
FIG. 12 is a sectional view taken generally along line 12—12 of FIG. 11.

Additionally, as seen in FIG. 12, a hollow ring 24 is removeably coupled to the lid 26 by an interference fit. This fit is created by the respective mating of the inner planar surfaces 74A–D of walls 72A–D of the lid 26 to outer planar surfaces 60A'–D' of the upper peripheral flange 58 of the hollow ring 24. If no hollow rings 24 are to be used to form the container 20, the lid 26 can similarly be coupled to the base 22 by an interference fit. This fit is created by the respective mating of the inner planar surfaces 74A–D of walls 72A–D of the lid 26 to outer planar surfaces 44A'–D' of the upper peripheral flange 42 of the base 22. Additional hollow rings 24 can be coupled to the container 20 in the same manner.

Unlike the lower peripheral flanges 64 of the hollow rings 24, the lower peripheral flange 72 of the lid 26 does not include any ribs to mate with the recesses 62 of the upper peripheral flange 58 of the hollow ring 24 or the recesses 46 of the upper peripheral flange 42 of the base 22. Thus a weaker interference fit is created between the lid 26 and the hollow ring 24 or the base 22, than is created between adjacent hollow rings 24 or between the hollow ring 24 and the ease 22. This allows the lid to be removed from the module (hollow ring 24 or base 22) it is coupled to while the other modules remain coupled together. The strong interference fit between and among the base 22 and hollow rings 24 additionally created by the ribs 68 and the respective recesses 62 or 46 allows the container 20 to have very good structural insulating properties.

An important feature of the present invention is that, to accommodate different sized-objects or payloads, the depth of the container 20, as measured along axis A, can be changed by adding or removing hollow rings 24. The container 20 can have no rings 24 or a multitude of rings 24. (Therefore, though two rings 24 are shown in FIGS. 1 and 11, the container can have no rings 24, one ring 24, two rings 24, or more than two rings 24.) This is accomplished by having the mating surfaces of the flanges 42, 58, 72 of all the modules 22, 24, 26 have substantially the same dimensions.

As seen in FIG. 11, the interior and exterior surfaces 38, 40 of the peripheral sidewall 30 of the base 22 are, respectively, substantially coplanar with the interior and exterior surfaces 54, 56 of the respective peripheral sidewalls 47 of the hollow rings 24 and with the interior and exterior surfaces 74A–D and 74A'–D' of the lid 26 to define a smooth sidewall of the container 20 that is substantially the same thickness along the depth of the container 20.

While particular embodiments of the present invention have been shown and described, it will be appreciated by those skilled in the art that changes and modifications may be made without departing from the invention in its broader aspects. Therefore, the aim in the appended claims is to cover all such changes and modifications as fall within the true spirit and scope of the invention. The matter set forth in the foregoing description and accompanying drawings is offered by way of illustration only and not as a limitation. The actual scope of the invention is intended to be defined in the following claims when viewed in their proper perspective based on the prior art.

What is claimed is:

1. An expandable container comprising:

a base having a sidewall with upper and lower ends and interior and exterior base surfaces, and a bottom wall integral with the lower end of the sidewall, the base including a base flange projecting from the upper end of the sidewall and having a peripheral base flange wall surface spaced from the interior and exterior surfaces of the sidewall, the base flange being formed of a flexible material and having at least one recess defining a notch opening at the peripheral base flange wall surface; and a hollow ring removably coupleable to the base having interior and exterior ring surfaces, and a lower ring flange having a peripheral ring flange wall surface spaced from the interior and exterior ring surfaces, the peripheral ring flange wall surface being shaped and dimensioned to mate with and create an interference fit with the peripheral base flange wall surface, the lower ring flange including a rib projecting laterally from the peripheral ring flange wall surface in a direction to mate with a corresponding notch on the base, the rib being shaped and dimensioned to mate with and create an interference fit with the corresponding notch to removably couple the ring to the base.

2. The container of claim 1, wherein when the ring is coupled to the base, the interior base surface is substantially coplanar with the interior ring surface.

3. The container of claim 2, wherein when the ring is coupled to the base, the exterior base surface is substantially coplanar with the exterior ring surface.

4. The container of claim 1, wherein the peripheral ring flange wall surface has parallel first and second lower surface portions and the base flange wall surface has parallel first and second upper and the distance between the the first and second lower surface portions is substantially equal to the distance between the the first and second upper surface portions.

5. An expandable container comprising:

a base having upper and lower ends, interior and exterior base surfaces and an upper base flange projecting from the upper end and having a peripheral base flange wall surface spaced from the interior and exterior base surfaces and at least one notch opening at the peripheral base surface; and a plurality of hollow rings, each ring having interior and exterior ring surfaces and upper and lower ring ends, an upper ring flange projecting from the upper ring end and having a peripheral upper ring flange wall surface spaced from the interior and exterior ring surfaces and at least one notch opening at the upper ring flange wall surface, and a lower ring flange projecting from the lower end and having a peripheral lower ring flange wall surface spaced from the interior and exterior ring surfaces, the peripheral lower ring flange wall surface being shaped and dimensioned to mate with and create an interference fit with the base flange wall surface or the upper ring flange wall surface of another ring, the lower ring flange having at least one rib projecting from the lower ring flange wall surface mateable with one of the notches of another ring or of the base to create an interference fit therewith.

6. The container of claim 5, and further comprising a lid having a lower lid flange interference fittable with either the upper ring flange wall surface or with the base flange wall surface.

7. The container of claim 5, wherein the rib is compressible.

8. The container of claim 7, wherein the rings and the base are formed of a foam material.

9. The container of claim 8, wherein the rings and the base are formed of an expandable polystyrene.

10. An expandable container comprising:

a first nesting module having a first peripheral sidewall with first upper and lower ends and first interior and exterior surfaces, the first module including a first flange projecting from one of the first upper or lower ends of the first peripheral sidewall and having a first peripheral flange wall surface spaced from the first interior and exterior surfaces, the first flange being formed of a flexible material and having at least one recess defining a notch opening at the first peripheral flange wall surface; and a second nesting module removably coupleable to the first nesting module and having a second peripheral sidewall with second upper and lower ends and second interior and exterior surfaces, and a second flange projecting from one of the second upper or second lower end having a second peripheral flange wall surface spaced from the second interior and exterior surfaces, the second peripheral flange wall surface shaped and dimensioned to mate with and create an interference fit with the first peripheral wall surface, the second flange including a rib projecting from the second peripheral flange wall surface in a direction to mate with a corresponding notch, the rib being shaped and dimensioned to create an interference fit with the corresponding notch to removably couple the second nesting module to the first nesting module, wherein at least one of the first and second modules has a bottom wall connected to the associated first or second peripheral sidewall.

11. The container of claim 10, wherein the first flange has a plurality of recesses and the second flange has a plurality of ribs respectively interference fittable with the recesses.

12. The container of claim 11, wherein each of the recesses is defined by first, second and third recess walls each having a length and each of the ribs is formed by first, second and third projection walls respectively having lengths substantially equal to the lengths of the first, second and third recess walls.

13. The container of claim 10, wherein the rib is compressible.

14. The container of claim 13, wherein the first and second nesting modules are formed of a foam material.

15. The container of claim 14, wherein the first and second nesting modules are formed of an expanded polystyrene.

* * * * *